United States Patent [19]

Willans

[11] 4,137,130

[45] Jan. 30, 1979

[54] AUTOMATIC STRIPPING OF CATHODE ZINC

[75] Inventor: Robert D. H. Willans, Trail, Canada

[73] Assignee: Cominco Ltd., Vancouver, Canada

[21] Appl. No.: 855,769

[22] Filed: Nov. 29, 1977

[30] Foreign Application Priority Data

Dec. 3, 1976 [CA] Canada ..... 267119

[51] Int. Cl.[2] ..... C25C 1/00; C25C 7/00; C25C 7/08

[52] U.S. Cl. ..... 204/12; 204/281

[58] Field of Search ..... 204/12, 281, 225, 226

[56] References Cited

U.S. PATENT DOCUMENTS

| | | | |
|---|---|---|---|
| 1,525,075 | 2/1925 | Hill | 204/12 |
| 3,579,431 | 5/1971 | Jasberg | 204/281 |
| 3,689,396 | 9/1972 | Casagrande et al. | 204/226 |
| 3,980,548 | 9/1976 | Sekine et al. | 204/281 |

FOREIGN PATENT DOCUMENTS

| | | | |
|---|---|---|---|
| 512913 | 11/1930 | Fed. Rep. of Germany | 204/12 |

*Primary Examiner*—T. M. Tufariello
*Attorney, Agent, or Firm*—Wenderoth, Lind & Ponack

[57] ABSTRACT

An apparatus for recovering electrodeposited metal in the form of a metal layer comprising: (a) means for supporting in a vertical position at least one basis metal cathode plate having adhering to at least part of at least one surface an electrodeposited metal layer wherein a boundary edge of the metal layer and the basis cathode plate metal each define one side wall of a V-shaped groove and the angle between the side walls of the groove is less than 90°; and (b) at least one unitary stripping means comprising a first stripping means integral with a second stripping means wherein the first stripping means comprises a wedge adapted to be inserted into the V-shaped groove to initiate separation of electrodeposited metal from the basis cathode plate and the second stripping means comprises a blade adapted to propagate said separation. A typical use of this apparatus is the separation of electrodeposited zinc from an aluminum basis metal cathode.

18 Claims, 6 Drawing Figures

AUTOMATIC STRIPPING OF CATHODE ZINC

BACKGROUND OF THE INVENTION

The present invention relates to an apparatus for recovering electrodeposited metal in the form of layers from basis metal electrodes. The present invention is particularly directed to recovering zinc from the aluminum cathodes commonly used in the electrowinning of zinc.

The method of recovering zinc of high purity by electrowinning requires that cathode plates and lead anodes be supported in electrolysis cells containing an appropriate zinc electrolyte. The usual cathode is commonly an aluminum base onto which the zinc is deposited. In such systems, the zinc deposit forms a layer which adheres to the aluminum cathode plate surface and this layer is detached to recover the zinc. Generally the zinc layer is detached by inserting a wedge like object between the metal layer and the aluminum cathode surface on which it adheres along an edge or at a corner of said metal layer to partially separate the zinc from the aluminum cathode surface approximately at the zinc/aluminum boundary. After this initial separation, the zinc deposit is peeled off in the form of a zinc layer. Such peeling operations have been carried out manually but various mechanical means have been devised wherein one cathode plate at a time has its surface layer or layers of metallic zinc removed. U.S. Pat. Nos. 3,689,396 and 3,847,779 for example, each disclose a mechanical apparatus which employs means to initiate separation and then uses a second separate and distinct means to complete the removal of the zinc layer from the basis metal cathode plate. However, as a consequence of one by one treatment of the aluminum cathode plates, the recovery rate of zinc layers is low, and this adds to the cost of the metal recovered. An apparatus for stripping coherent metal layers from a plurality of basis metal cathode plates simultaneously would therefore increase the productivity and lower the cost of recovering electrodeposited zinc or other like metal.

SUMMARY OF THE INVENTION

Accordingly, there is provided by the present invention an apparatus for recovering electrodeposited metal in the form of a metal layer comprising:

(a) means for supporting in a vertical position at least one basis metal cathode plate having adhering to at least part of at least one surface an electrodeposited metal layer wherein a boundary edge of the metal layer and the basis cathode plate metal each define one side wall of a V-shaped groove and the angle between the side walls of the groove is less than 90°; and (b) at least one unitary stripping means comprising a first stripping means integral with a second stripping means wherein the first stripping means comprises a wedge adapted to be inserted into the V-shaped groove to initiate separation of electrodeposited metal from the basis cathode plate and the second stripping means comprises a blade adapted to propagate said separation.

According to a feature of this invention a unitary stripping means may effect separation of a zinc layer or other metal from the basis metal cathode plate surface by a linear motion relative to said surface and the metal layer in the plane of the intermetallic boundary of the electrodeposited metal and the basis metal cathode plate, or substantially so.

Conveniently, the unitary stripping means is arranged so that the wedge of the first stripping means is insertable into a V-shaped groove located at an upper corner of the deposited metal on the basis metal cathode plate. The groove may be formed by carrying out electrodeposition with a suitably shaped insulator attached to the edge of the cathode.

BRIEF DESCRIPTION OF THE DRAWINGS

The invention will now be described by way of reference to the following drawings wherein.

DETAILED DESCRIPTION OF THE INVENTION

Figure 2:
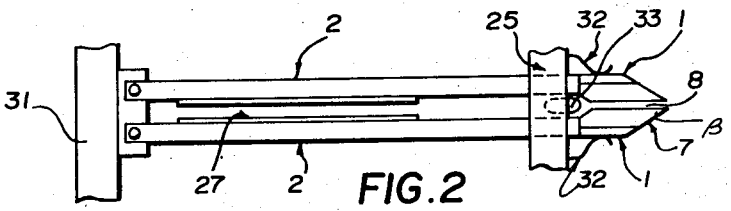
FIG. 2 is a top view of a pair of unitary stripping means illustrated in FIG. 1, and adapted to remove deposited metal from two opposite surfaces of a cathode simultaneously.
Figure 1:
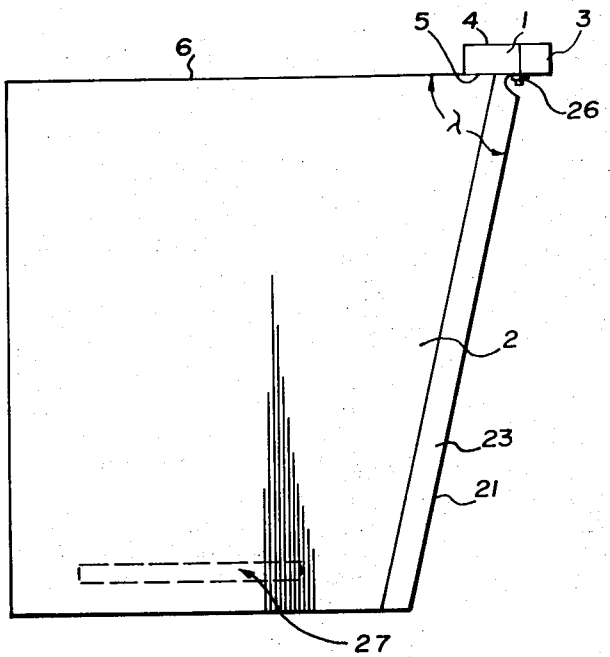
FIG. 1 is a side view of a unitary stripping means.

The unitary stripping means illustrated by FIG. 1 comprises a first stripping means 1 and a second stripping means 2. The first stripping means is located at an upper corner of the second stripping means and is integrally attached to the second stripping means. The first stripping means is wedge like and in the particular embodiment illustrated in FIG. 1 it has a substantially linear leading edge 3 and upper and lower edges 4 and 5 which are substantially parallel to the abutting upper edge 6 of the second stripping means 2. Referring to FIG. 2, the bevelled lateral face 7 and the lateral face 8 of the first stripping means 1 demarcating the leading edge 3 define an angle $\beta$. This angle $\beta$ must be such that the bevelled lateral face 7 does not come into butting contact with the edge of the metal layer which partially defines a V-shaped groove which leading edge 3 enters to initiate separation of a metal layer from a cathode. The first stripping means must thus be insertable in the groove as defined by a boundary edge of the metal layer and the basis metal cathode plate. The boundary edge of the metal layer defines one side wall of the V-shaped groove and the basis cathode plate metal defines the other side wall. While the angle between the side walls of the V-shaped groove must be greater than the angle $\beta$, the angle between these side walls must not be greater than 90° so that leading edge 3 will not be guided to veer off the edge of the metal layer to ride on the outer surface of the deposited metal. If the angle between the side wall defined by the boundary edge of the metal layer and the side wall defined by the basis metal cathode plate is less than the angle $\beta$, a fragile metal edge so formed may be broken off by the butting referred to above.

The V-shaped groove is preferably formed by providing an upper corner of the basis metal cathode plate with a removable, shaped insulator which may or may not be an integral part of a non-conducting edge strip used to prevent electrodeposition of metal on a side edge of the cathode.

Figure 3:
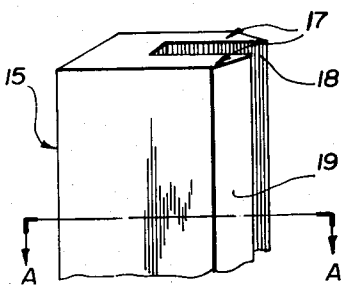
FIG. 3 is a side perspective view of the upper portion of an edge insulator which is adapted to provide a V-shaped groove.
Figure 4:
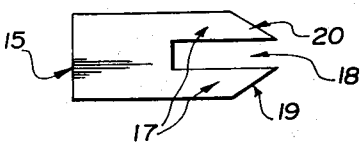
FIG. 4 is a cross-sectional view A—A of the edge insulator illustrated in FIG. 3.
Figure 5:
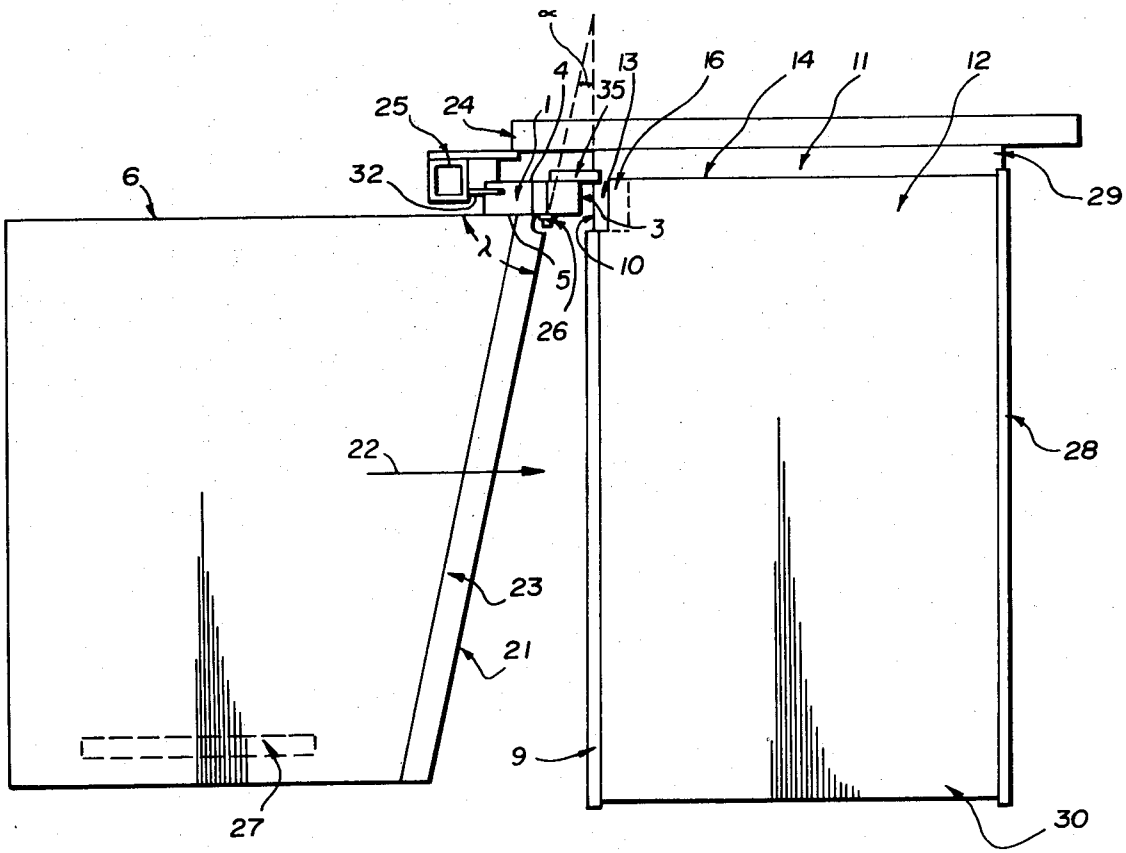
FIG. 5 is a side view of a unitary stripping means and a cathode plate prior to recovering the metal layer.

The invention will first be described in a modification shown in FIG. 5 wherein the non-conducting edge strip 9 is of conventional construction and extends along a side edge 10 of the basis cathode plate 11 on which metal layer 12 is deposited, except for an upper corner portion 13. During electrodeposition, corner portion 13, extending from boundary edge 14 of metal layer 12 formed at the solution line during electrodeposition to the top edge of strip 9, is covered by edge insulator 15, as shown in FIGS. 3 and 4. The edge insulator 15 is conveniently adapted to be attached at a corner of the basis cathode plate when the basis cathode plate is put into the cell, so that when this edge insulator is removed after electrodeposition of the metal, as shown in FIG. 5, a V-shaped groove 16 is exposed extending substantially vertically from the boundary edge 14 of the metal layer adjacent lateral edge 10 of the basis cathode plate 11 to the upper end of edge strip 9.

It is to be noted that the edge insulator thus illustrated is to be used on a basis metal cathode plate to provide V-shaped grooves on opposite surfaces of the plate on which an electrodeposited metal layer is to be formed, a modification of the invention which will be hereinafter described more fully. Such an edge insulator can be modified to suit a basis metal cathode plate wherein only one metal layer is to be deposited on one surface.

Edge insulator 15 has, as seen in FIG. 4, two projections 17. These projections form the side walls of a channel extending the length of the insulator. The gap 18 between the projections is sized such that this edge strip channel is capable of receiving an edge of the basis cathode plate and the side walls can engage opposite surfaces of the cathode plate in a close fitting manner. As illustrated in FIG. 4, the projections which form the side walls are provided with complementary bevelled lateral faces 19 and 20. During electrodeposition when this insulator 15 is in place on the cathode plate edge the metal deposit built up on the cathode plate adjacent to one of these bevelled faces takes on a complementary shape and thus provides the necessary V-shaped groove described above. Although the insulator 15 has been described as being separate it may be integral with edge strip 9. If so, edge strip 9 is removed from the cathode before the stripping operation. Moreover, insulator 15 or the combination with edge strip 9 may be adapted in any suitable manner to allow for automatic rather than manual handling to engage and disengage it with respect to the basis cathode plate edge.

Generally, the second stripping means 2 includes a blade with a cutting edge. This second stripping means must be adapted so that, as it moves towards the lateral edge 10 of the basis cathode plate adjacent the upper part of which the V-shaped groove extends, its cutting edge 21 defines with said lateral edge 10 an approach angle $\alpha$ of not less than 5 degrees at any working point on the blade. If this angle is too small, desired progressive peeling of the metal layer as it is separated by the first stripping means is not assured. Generally, the value of the approach angle depends on whether the basis metal cathode plate retains an edge insulator 9, as illustrated in FIG. 5, when the metal layer is to be peeled off of the basis cathode plate. When such an edge insulator is present, an approach angle $\alpha$ of not less than 10° may be needed to ensure that progressive peeling of the metal layer off of the basis cathode plate to form a space between the partially separated metal layer and the cathode plate will occur when the second stripping means has moved sufficiently for the stripped metal to clear the edge insulator 9 before each successive portion of cutting edge 21, which is also spaced from the surface of the cathode to clear edge strip 9, enters into said space. More particularly, with respect to the stripping means illustrated in FIG. 5, wherein the stripping is accomplished by motion of the stripping means in the direction 22, the stripping means is conveniently constructed so that upper and lower edges 4 and 5 of the first stripping means, which leading edge 3 intersects substantially at right angles, are substantially parallel to the edge 6 which lower edge 5 abuts, of the second stripping means and are adjacent to an upper corner defined by blade edge 21 and upper edge 6, said upper corner having an angle $\lambda$ which complements the approach angle $\alpha$. The angle $\lambda$ can therefore be in the range of 85° or less when edge insulator 9 has been removed or 80° or less when edge insulator 9 remains on the cathode. If the basis metal cathode plate does retain such an edge insulating strip 9 during stripping then, referring to FIG. 5, the blade edge 21 is spaced laterally from lateral face 8 of the first stripping means to ensure that the blade edge 21 will clear the edge insulating strip 9 during the stripping process. Referring to FIGS. 1 and 2 the blade face 23 may complement the bevelled lateral face 7 of the first stripping means or may be inclined at a smaller angle to the direction of travel 22.

The operation of the stripping unit will now be discussed in its essential details. After removal of the cathode plate carrying a layer of electrodeposited metal from the electrolysis cell and any handling to remove any surface electrolyte adhering to the surface of the electrodeposited metal layer, the edge insulator strip 15 responsible for the formation of the V-shaped groove is removed to expose the corner portion 13 and the groove 16 as illustrated in FIG. 5. The basis cathode plate with the metal layer adhering to it is then suitably positioned and supported for the recovery of the metal layer. For example, the cathode carrying the electrodeposited metal may be lowered into the stripping apparatus with header bar 24 engaging the frame of the stripping apparatus, partially shown as 25, and the cathode adequately supported to withstand thrust of means (e.g., hydraulic means not shown) for moving the unitary stripping means. Referring to FIG. 5, the stripping means is advanced in the direction of the arrow 22 and the leading edge 3 of first stripping means 1 is caused to move on exposed portion 13 and enter groove 16. Continuous movement of the unitary stripping means in the direction of the arrow 22 and substantially in the plane of the intermetallic boundary of the electrodeposited metal on the cathode plate then effects separation of the electrodeposited metal layer from the basis metal cathode plate along the intermetallic boundary. In this operation, means is provided to advance support means for the unitary stripping means through a first position wherein the first stripping means engages the groove 16, to initiate separation of the metal layer from the basis metal cathode plate, to a second position wherein the second stripping means effects substantial separation of the metal layer from the basis cathode plate.

This basic operation is capable of being refined in a number of ways. Some of these features will now be discussed.

The first stripping means initially scrapes the surface of the basis metal cathode plate in order to get between the basis metal cathode plate and the electrodeposited metal layer. It is highly undesirable to damage or mar the surface of the basis metal cathode plate. In order to minimize marring the portion of the basis metal cathode plate surface on which metal is deposited, means, e.g., a roller 26, as illustrated in FIG. 1, may be provided to force the first stripping means away from the base cathode plate surface. This roller should be positioned so as to provide such clearance just after the first stripping means initiates separation but before the second stripping means is moved inbetween the partially separated cathode plate and metal layer. Preferably, the roller should provide a clearance of ⅛ inch between the first stripping means and the basis cathode plate. It should be noted that as the unitary stripping means advances, the lower portion of the second stripping means not adjacent to the first stripping means will enter between the metal layer and the basis metal cathode plate. To ensure that this part of the unitary stripping means does not mar the basis metal cathode plate surface, the second stripping means may be provided with a resilient means which spaces its side walls from the cathode plate surface. Preferably, this resilient means can be a rubber strip 27 as shown in FIGS. 1 and 2, attached to the lower portion of the second stripping means. Such a rubber strip will not only prevent scratching of the basis metal cathode plate surface but, on advancing, will engage edge insulating strip 9, if present. If edge insulating strip 9 is loose, this action will move it into more secure engagement with cathode plate 11.

Referring to FIG. 5 the basis metal cathode plate may have a second non-conducting edge strip 28 extending along and preventing electro-deposition of metal on edge 29 opposite to lateral edge 10 at which the stripping means enters. In order to avoid possible damage or removal of this edge strip by the unitary stripping means, the unitary stripping means can be moved so that the first stripping means is just adjacent to the edge insulating strip 28. The blade edge of the second stripping means naturally will thus not be moved up to the basis metal cathode plate edge 29 covered by the edge insulating strip 28, and, therefore, will not enter between the deposited metal and the cathode plate near the lower remote corner 30 of the cathode plate. Normal adhesion of the metal on the basis metal cathode plate, such as zinc on an aluminum cathode, is such that there will still be sufficient wedging action to entirely separate the metal layer in this way. However, if a part of the metal layer still adheres to the basis metal cathode plate surface, raising of the cathode plate as it is removed from the stripping apparatus while the unitary stripping means is still in its moved position causes cutting edge 21 to enter between the metal sheet and the remaining portion of the cathode plate, thus completing the separation. Where there are two opposite metal layers on a basis metal cathode plate, cutting of deposited metal along the connecting bottom edge is not essential.

Optionally the basis metal cathode plate assembly need not include an edge insulating strip 28. The unitary stripping means in this case can move all the way across the basis metal cathode plate surface and, where the basis metal cathode plate supports two opposite metal layers, shear any electrodeposited metal joining the two opposite sheets along the edge of the basis metal cathode plate which does not have an edge insulating strip 28.

Preferably, the unitary stripping means is mounted on support means 31 and the apparatus is provided with guide means, e.g., springs 32 and cam 33, adapted to move linear leading edge 3 of the first stripping means 1 first laterally away from the plane of the surface of the basis cathode plate 11 as leading edge 3 approaches lateral edge 10 of the cathode plate and then toward said surface to press leading edge 3 against the surface as support means 31 approaches the first position of support means 31 wherein the first stripping means engages groove 16.

Figure 6:
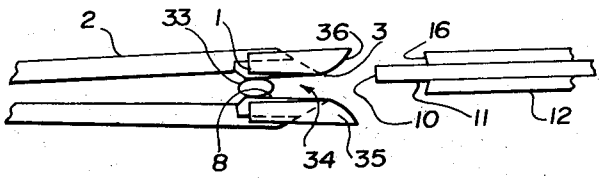
FIG. 6 is a top view of a pair of unitary stripping means illustrated in FIG. 1; including alternate means to guide the unitary stripping means to engage the V-shaped groove.

Although the above description has been directed mainly to considering one unitary stripping means in relation to only one metal layer supported on a basis cathode plate it is preferred practice to operate with two such unitary means adapted to cooperate to simultaneously strip two metal layers supported on opposite surfaces of a basis cathode plate. Preferably, the basis cathode metal plate is positioned and supported so that the two unitary stripping means can be advanced together to engage simultaneously metal layers deposited on both sides of the basis metal cathode plate. For example, as shown in FIG. 2, two unitary stripping means each comprising first stripping means 1 and second stripping means 2 are pivotally mounted at one end on support means 31 and are biased by springs 32 to engage cam 33. In the retracted position of the unitary stripping means and on their initial movement, lateral faces 8 of first stripping means 1 or equivalent cam followers may ride on cam 33 with their leading edges 3 moved laterally away from the planes of the corresponding surfaces of the cathode plate 11 to be spaced apart a distance slightly greater than the thickness of cathode plate 11 thereby promoting clear passage of edges 3 beyond cathode edge 10. Assurance of alignment of cathode edge 10 with opened gap 34 between leading edges 3, FIG. 6, may be obtained by mounting horns 35 on top of the first stripping means so that converging faces 36 guide lateral edge 10 of misaligned cathode 11 into the gap 34. During stripping, horns 35 clear top edges 14 of the deposited metal 12. Immediately on passing of leading edges 3 beyond cathode edge 10, faces 8 or cam followers act on cam 33 to permit lateral faces 8 to make the required close contact with the surfaces of upper corner portions 13 on both sides of the basis metal cathode plate 11. Support means 31 is then moved through a first position wherein each first stripping means 1 enters into its corresponding V-shaped groove, the grooves being on opposite sides of the basis metal cathode plate. Thereafter, there is continuous advance of support means 31 to second position wherein each second stripping means 2 effects substantial separation of metal layers 12 as described below.

The above describes the use of unitary stripping means to separate metal layers from a single cathode. The greatest advantage of the proposed unitary stripping means is that it can be adapted to strip simultaneously a plurality of basis metal cathode plates at the same time, thereby greatly increasing productivity. In such an apparatus a set containing a plurality of basis metal cathode plates having metal layers adhering to opposite surfaces is suitably positioned and supported. A pair of unitary stripping means is provided for each basis metal cathode plate and may be mounted on support means 31, substantially parallel to and spaced from the pair of unitary stripping means shown in FIG. 2. Preferred spacing is that of alternate cathodes in an electrolytic cell. This spacing of substantially parallel cathodes is adequate for entry of adjacent pairs of unitary stripping means between the cathodes and for two thicknesses of stripped metal between each adjacent pair of unitary stripping means. There is no hindrance between adjacent working unitary stripping means. Normal practice for removing alternative cathodes from a cell permits uninterrupted continuation of electrolysis with the remaining alternate cathodes. It is convenient to mount the required number of unitary stripping means on a single carriage. Once the set of cathode plates as described above is in position the carriage supporting the unitary stripping means is then moved, to bring the set of unitary stripping means towards their respective V-shaped grooves and stripping each electrodeposited metal layer as described above. The force required during such multi-stripping is at the peak during the initial parting of the electrodeposited metallic layer from the basis metal cathode plate so that the power to drive the carriage can be reduced by positioning each pair of unitary stripping means to enter its respective V-shaped grooves at a different time.

Simultaneous stripping of a plurality of basis metal cathodes is most advantageous when there has been complete removal of the edge insulators from the stripping means entry side of cathodes which have had no edge insulators on the remote side during electrolysis. In this case, edge insulators 15 which form V-shaped grooves are preferably integral parts of the corresponding nonconducting edge strips 9. In normal operation it is not necessary to advance blade edges 21 beyond remote edges 29 of the cathodes to effect complete separation. As the upper ends of edges 21 approach cathode edges 29, deposited metal adjacent edges 29 is stretched and partially torn, and falls away from the cathodes. This embodiment provides stripped cathodes which are easily cleaned without hindrance of remaining edge strips. It is possible to back up the stripping means without separating edge insulators otherwise retained on the entry side. This backing up is particularly advantageous in cases of very easy separation of deposited metal which may result in premature pivotal falling of separated sheets.

What I claim as my invention is:

1. In an apparatus for the separation of a layer of electrodeposited metal from the surface of a basis metal electrode plate wherein the separation is effected by detaching the electrodeposited metal from the basis metal electrode by a stripping means inserted between the electrodeposited metal and the electrode, and moved substantially in the plane of the intermetallic boundary and wherein at least a portion of one boundary edge of the electrodeposited metal and an exposed portion of the basis metal electrode plate face, exposed by the removal of an edge insulator strip, each comprise the faces of a V-shaped groove, the included angle between the faces defining the groove being less than 90°, and wherein the basis metal electrode plate carrying the layer of electrodeposited metal is supported in a substantially vertical position during the separation process, the improvement comprising a single unitary stripping means incorporating therein in integral relationship a first stripping means and a second stripping means, together with support means for the single unitary stripping means, wherein:

(a) the first stripping means comrises a wedge adapted to be inserted into the V-shaped groove to initiate separation of the electrodeposited metal from the basis metal electrode plate;

(b) the second stripping means comprises a blade adapted to propagate the separation of the electrodeposited metal from the basis metal electrode plate; and (c) the support means comprises a mounting for the single unitary stripping means and includes means for the continuous movement of the single unitary stripping means substantially in the plane of the intermetallic boundary through a first position whereat the first stripping means engages the V-shaped groove and initiates separation of the electrodeposited metal from the basis metal electrode plate, through an intermediate position whereat the second stripping means enters the gap resulting from the initial separation of the electrodeposited metal from the basis metal electrode plate, and to a third position whereat the cooperating action of the first and second stripping means causes substantial separation of the electrodeposited metal from the basis metal electrode plate.

2. An apparatus as defined in claim 1, wherein the metal layer has been electrodeposited on the basis metal cathode plate so as to provide the V-shaped groove.

3. An apparatus as defined in claim 1, wherein the unitary stripping means includes means adapted to provide a clearance between the basis metal cathode plate and the first stripping means, said means adapted to provide said clearance, engaging the surface of the cathode plate as the support means mounting the unitary stripping means moves between said first and second positions.

4. An apparatus as defined in claim 1 wherein the V-shaped groove extends along a boundary edge of the metal layer adjacent to a lateral edge of the basis metal cathode plate.

5. An apparatus as defined in claim 1 wherein the support means mounting the unitary stripping means moves horizontally between said first and second position and said V-shaped groove is located at a corner of the metal layer adjacent a lateral edge of the basis metal cathode plate and extends substantially vertically from a boundary edge of the metal layer formed at the solution line during electrodeposition.

6. An apparatus as defined in claim 5 wherein said second stripping means has a blade edge and an upper corner defined by the blade edge and an upper edge of the second stripping means wherein the angle between the blade edge and said upper edge is not more than 85°, the first stripping means being located adjacent to the upper corner and including a lower edge parallel to and abutting the upper edge of the second stripping means.

7. An appratus as defined in claim 6 wherein the first stripping means includes a wedge having a substantially linear leading edge substantially perpendicular to the upper edge of the second stripping means.

8. An apparatus as defined in claim 7 including unitary stripping means pivotally mounted on the support means mounting said unitary stripping means and guide means adapted to move the leading edge of the first stripping means first laterally away from the plane of the surface of the basis metal cathode plate and then toward said surface to move said exposed portion of the basis metal cathode plate surface as the support means mounting the unitary stripping means approaches said first position.

9. An apparatus as defined in claim 8, wherein horns mounted on the top of the first stripping means have converging faces adapted to guide the lateral edge of a misaligned cathode into the gap between the leading edges of a cooperating pair of unitary stripping means.

10. An apparatus as defined in claim 8, wherein the unitary stripping means includes means adapted to provide a clearance between the basic metal plate and the first stripping means, said means adapted to provide said clearance engaging the surface of the basic metal cathode plate as the unitary stripping means moves between said first and second positions.

11. An apparatus as defined in claim 10 wherein the means providing said clearance includes a roller spaced from the leading edge of said first stripping means and adapted to approach said lateral edge of the basis metal cathode plate as the support means mounting the unitary stripping means approaches said first position.

12. An apparatus as defined in claim 1 including two cooperating unitary stripping means adapted to recover electrodeposited metal from a basis metal cathode plate supporting two metal layers on opposite surfaces.

13. An apparatus as defined in claim 11 including two cooperating unitary stripping means adapted to recover electrodeposited metal from a basis cathode plate supporting two metal layers on two opposite surfaces.

14. An apparatus as defined in claim 13 including means for supporting a plurality of said basis metal cathode plates and pairs of said unitary stripping means equal in number to the number of said basis metal cathode plates.

15. An apparatus as defined in claim 13 including means mounted on top of said first stripping means and adapted to act on said cathode plate to guide the lateral edge of the basis metal cathode plate into a gap between the leading edges of a pair of first stripping means when the leading edge of each unitary stripping means is moved laterally away from the plane of the corresponding surface of the basis cathode plate.

16. An apparatus as defined in claim 12 including means for supporting a plurality of said basis metal cathode plates and pairs of said unitary stripping means equal in number to the number of said basis metal cathode plates.

17. In a method for recovering an electrodeposited metal layer adhering to at least a part of at least one surface of a basis metal electrode plate, wherein at least a portion of a boundary edge of the electrodeposited metal layer and an exposed portion of the surface of the basis metal electrode define the faces of a V-shaped groove, the included angle between the faces of the groove being less than 90°, the improvement comprising:

(a) supporting in a substantially vertical position the basis metal electrode plate having the layer of electrodeposited metal adhering thereto;

(b) moving into the V-shaped groove a unitary stripping means comprising a first stripping means adapted to initiate separation of the electrodeposited metal from the basis metal electrode plate and a second stripping means integral with the first stripping means adapted to propagate the separation thus initiated;

(c) continuing the movement of the unitary stripping means substantially in the plane of the intermetallic boundary between the electrodeposited metal and the basis metal electrode plate for a sufficient distance and with a sufficient force to effect substantial separation of the electrodeposited metal from the basis metal electrode plate.

18. A method as defined in claim 17 including the step of electrodepositing the metal on a basis metal cathode plate which includes a removable edge insulator adapted so that the metal deposited adjacent to the insulator defines a side wall of the V-shaped groove.

* * * * *